United States Patent [19]

Miyawaki et al.

[11] Patent Number: 4,560,405

[45] Date of Patent: Dec. 24, 1985

[54] PROCESS FOR DESULFURIZING MOLTEN STEEL

[75] Inventors: Yoshiharu Miyawaki, Fukuyama; Masayuki Hanmyo, Tokyo; Yusuke Shiratani, Fukuyama; Yasuhiro Matsuda, Hiroshima; Yoshimi Komatsu, Fukuyama; Tsuneo Kondo, Fukuyama; Tsutomu Usui, Fukuyama, all of Japan

[73] Assignee: Nippon Kokan Kabushiki Kaisha, Tokyo, Japan

[21] Appl. No.: 674,565

[22] Filed: Nov. 26, 1984

[30] Foreign Application Priority Data

Sep. 3, 1984 [JP] Japan ..... 59-184154

[51] Int. Cl.[4] ..... C21C 5/52

[52] U.S. Cl. ..... 75/12; 75/53; 75/58; 75/257

[58] Field of Search ..... 75/53, 58, 257, 12

[56] References Cited

U.S. PATENT DOCUMENTS 4,308,415 12/1981 Hasegawa ..... 75/12

4,341,554 7/1982 Koras ..... 75/58

4,362,556 12/1982 Kishida ..... 75/58

OTHER PUBLICATIONS

McGannon, *The Making, Shaping & Treating of Steel* (8th ed.), p. 314, (1964).

*Primary Examiner*—Peter D. Rosenberg

*Attorney, Agent, or Firm*—Frishauf, Holtz, Goodman & Woodward

[57] ABSTRACT

A process for desulfurizing molten steel comprising the steps of: removing converter slag from molten steel; adding a desulfurizing flux onto the molten steel from which the converter slag has been removed; supplying power to electrodes at a predetermined distance from the molten steel so as to generate an electric arc, the desulfurizing flux being melted by arc-heating so as to form the slag; and introducing a gas into the molten steel through a lance submerged into the molten steel to stir the molten steel and the slag which are arc-heated. In the process the desulfurizing flux is melted to a slag consisting essentially of 53 to 62% of CaO, 0 to 15% of $SiO_2$, and 30 to 45% of $Al_2O_3$.

7 Claims, 7 Drawing Figures

PROCESS FOR DESULFURIZING MOLTEN STEEL

BACKGROUND OF THE INVENTION

The present invention is related to a process for desulfurizing molten steel to a sulfur content of 5 ppm or less.

Even if molten pig iron is desulfurized, it is difficult to obtain molten steel with a sulfur content of 10 ppm or less. Generally, in order to obtain a low sulfur steel, the molten steel is desulfurized after pouring or changing the molten steel from the converter to a ladle.

A conventional method for desulfurizing molten steel includes blowing a desulfurizing flux into the molten steel by degassing equipment or injection equipment. Another method includes shooting calcium particles into the molten steel.

However, in these processes, in addition to high cost, since the flux is not sufficiently slagged, it is difficult to obtain an ultra low sulfur steel having a sulfur concentration of 5 ppm or less.

In another method, after a desulfurizing flux is added to the molten steel in the ladle, Ar gas is blown into the molten steel so as to stir the molten steel. However, when the molten steel is poured into the ladle, converter slag flows into the ladle from the converter. The composition of the converter slag may not be preferable for desulfurization or may be highly oxidized. For this reason, in this process, ultra low sulfur steel cannot be regularly obtained. Since the flow amount and the composition of the converter slag having a low desulfurizing efficiency change, it is difficult to optimally control the composition of the desulfurizing slag in the desulfurizing process. In addition to this, although the flux is slagged by the heat of the converter slag and the molten steel, the flux cannot always be slagged sufficiently by this process.

When MnS inclusions form in the steel, these inclusions are drawn by the rolling of the steel and serve as traps for hydrogen, thereby easily causing hydrogen-induced cracking. For this reason, pipe line steel which is particularly used in cold areas must be free from precipitation of MnS. One way to prevent MnS inclusions from occurring is to add Ca in the molten steel to precipitate CaS. In the case of CaS, even if the steel is rolled, CaS inclusions maintain spherical shapes. Therefore, hydrogen-induced cracking does not easily occur.

Various methods for adding Ca in the molten steel are known. These include an injection method in which a Ca alloy powder such as Ca-Si alloy is carried by a gas and blown into the molten steel through a lance, a shooting method in which Ca alloy particles are shot into the molten steel, and a Ca-wire method in which Ca alloy wires coated with iron are added to the molten steel. However, since Ca has a boiling point 1,483° C. lower than the melting point of steel and an extremely high steam pressure, the Ca addition yield is very low, e.g., about 10%, and this yield varies widely. For this reason, the expensive Ca alloy is used wastefully. In addition to this, by adding Ca, hydrogen and nitrogen is increased and an undesirable decrease in the temperature occurs.

SUMMARY OF THE INVENTION

It is an object of the present invention to provide a process for desulfurizing molten steel in which an ultra low sulfur steel having a sulfur concentration of 5 ppm or less can be stably refined at low cost.

According to the present invention, there is provided a process for desulfurizing molten steel comprising the steps of: removing converter slag from molten steel; adding a desulfurizing flux onto the molten steel from which the converter slag has been removed; supplying power to electrodes at a predetermined distance from the molten steel so as to generate an electric arc, the desulfurizing flux being melted by arc-heating so as to form slag; and introducing a gas into the molten steel through a lance submerged into the molten steel to stir the molten steel and the slag which are arc-heated.

According to the present invention, the converter slag which is highly oxidized and has a low desulfurizing efficiency is removed, and thereafter, a flux portion of a composition having a high desulfurizing efficiency is added to the molten steel. When an electric arc is generated between the electrodes and the molten steel, this flux is melted by arc-heating, thereby forming slag. Therefore, additive flux is slagged in a short period of time, and the slag suitable for desulfurizing can be formed. For this reason, when a gas such as Ar gas is introduced in the molten steel to stir the molten steel while arc-heating is performed, the molten steel effectively reacts with the slag, thus improving the desulfurizing efficiency. Furthermore, when a gas such as Ar gas is introduced in the molten steel to stir the molten steel more vigorously after arc-heating, the desulfurizing efficiency can be further improved.

In this manner, according to the present invention, ultra low sulfur steel having a sulfur concentration of 5 ppm or less can be stably manufactured. Since the molten steel has a low sulfur content, the amount of Ca used can be small when the form of sulfide inclusion is controlled by adding Ca to the molten steel, thus achieving a high Ca addition yield.

DETAILED DESCRIPTION OF THE PREFERRED EMBODIMENT

In desulfurizing slag of a lime type, a slag composition suitable for desulfurizing must fall within a range in which a sulfide capacity Cs' becomes maximum in a temperature range in which the slagging of lime can be performed.

$$Cs' = Ks' \times \{(a_{cao} \cdot f_s)/(f'_{cas})\} = (S)/[S] \times a_o \quad (1),$$

where Ks' is an equilibrium constant in a chemical reaction of the following formula:

$$(CaO) + [S] \rightarrow (CaS) + [O] \quad (2),$$

where (S) is a sulfur content in the slag, and [S] is the same in the molten steel.

Figure 1:
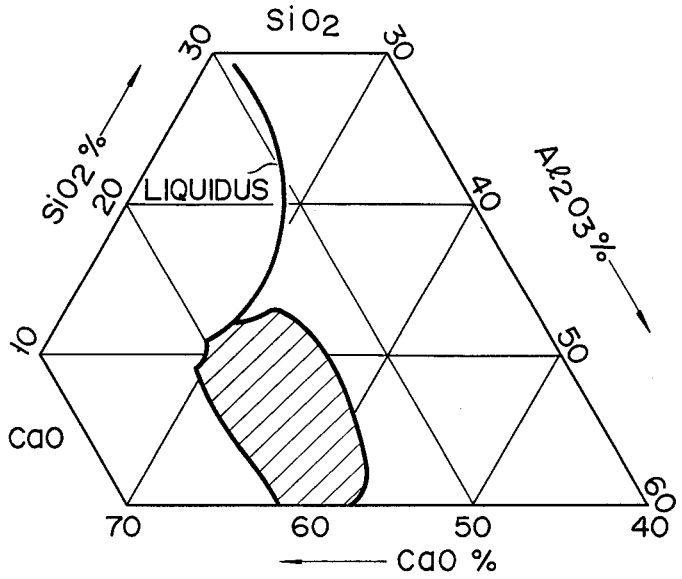
FIG. 1 is a phase diagram showing the optimal slag composition.

The slag composition suitable for desulfurizing is the hatched region in FIG. 1, showing the phase diagram at 1,600° C. of $CaO—SiO_2—Al_2O_3$ slag. According to this, when the CaO content falls within the range between about 53% and 62 wt.%, the $SiO_2$ content falls within the range between 0% and about 15 wt.%, and the $Al_2O_3$ content falls within the range between about 30% and 45 wt.%, the slag desulfurizing efficiency is highest. However, in practice, the composition of a converter slag is very different from the optimal slag composition.

The present invention has been made in consideration of the above situation. When the molten steel poured from a converter to a ladle is desulfurized and refined, converter slag on the molten steel is removed, and a flux having an optimal composition for desulfurizing is added to the molten steel in the ladle. Thereafter, the molten steel is arc-heated, and this flux is slagged. Thus, the molten steel is desulfurized by a reaction between the desulfurizing slag and the molten steel.

An embodiment of the present invention will be described in more detail hereafter. First, the molten steel is poured from the converter into the ladle, and the ladle is conveyed to equipment for slagging-off the converter slag on the molten steel. This converter slag is preferably removed by a vacuum slag cleaner (hereafter abbreviated as VSC) using a vacuum suction technique. In this process, a suction head coupled to a vacuum pump is lowered to the surface of the molten steel in the ladle, and the converter slag on the molten steel is drawn by suction through the suction head. By such a VSC process, the converter slag on the molten steel can be completely removed. Also, the converter slag on the molten steel can be dragged off from the ladle by a slag dragger.

Figure 2:
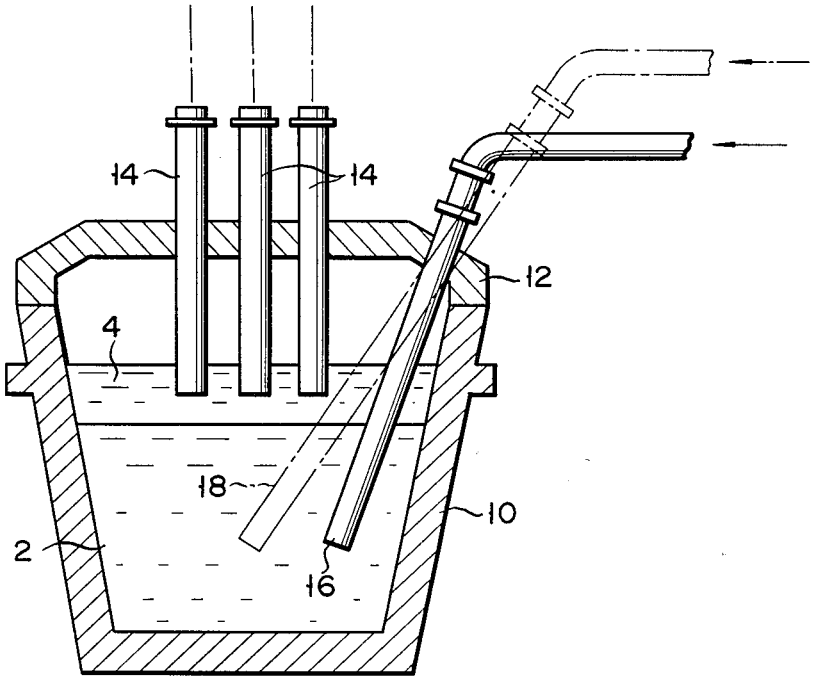
FIG. 2 is a sectional view showing an apparatus used in an embodiment of the present invention.

FIG. 2 shows a ladle refining apparatus of the molten steel which uses an arc process. After removing the converter slag, a desulfurizing flux is added to a ladle 10. This desulfurizing flux is a flux having the optimal composition for desulfurizing, indicated by the hatched region in FIG. 1. A cap 12 is placed on the ladle 10. Three electrodes 14 and a lance 16 are inserted in the ladle 10 through holes formed in the cap 12. The electrodes 14 are made of carbon rods and are connected to a three-phase AC power supply through a transformer of, e.g., 40,000 KVA (neither are shown). The electrodes 14 are vertically arranged so as to be vertically movable. When molten steel 2 is arc-heated, the electrodes 14 are spaced by a predetermined distance from the molten steel 2 and are positioned so as to dip into the slag on the surface of the molten steel 2. The lance 16 has a surface made of a refractory material and is coupled to a supply source of Ar gas. The lance 16 is inserted slightly obliquely in the ladle 10 and has a gas blowing off hole at its lower end. Ar ga is blown into the molten steel 2 through the lance 16, thereby stirring the molten steel 2.

After placing the cap 12 on the ladle 10, Ar gas is introduced into the ladle 10. A pipe (not shown) is connected to a space in the ladle 10 to introduce Ar gas through this pipe. A gas introduced in the ladle space for stirring is not limited to Ar gas, but can be any inert gas which does not react with the molten steel.

An electric arc is generated between the electrodes 14 and the molten steel 2. Thus, the molten steel 2 is arc-heated and the flux is melted so as to form a layer of desulfurizing slag 4 on the molten steel 2. In the case of arc-heating, a tap voltage is, e.g., 410 to 435 V, and an arc current is 50,000 A. Under these heating conditions, the flux is melted in about 10 minutes. While the molten steel 2 is arc-heated, Ar gas is introduced in the molten steel at a flow rate of, e.g., 400 to 800 Nl/min (1.6 to 3.2 Nl/min for 1 ton of the molten steel) through the lance 16 so as to moderately stir the molten steel 2 without intereferring with the arc-heating. Thus, the temperature of the molten steel 2 and the slag 4 is kept uniform, and the molten steel 2 and the slag 4 are stirred and mixed, thus performing a desulfurizing reaction in the molten steel 2. Then, arc-heating is terminated and the electrodes 14 and the lance 16 are raised from the ladle 10. Thereafter, aluminium (Al), silicon (Si) and the like are added to the molten steel, thereby deoxidizing the molten steel. Furthermore, manganese (Mn) is added to the molten steel 2 so as to adjust the composition of the molten steel 2. Thereafter, a lance 18 for vigorous stirring is inserted into the ladle 10 so that a blowing off hole thereof is located at substantially the center of the molten steel 2. Ar gas is blown into the molten steel 2 at a high flow rate through the lance 18, thereby vigorously stirring the molten steel 2. The flow rate of the stirring gas is, e.g., 2,000 Nl/min (8 Nl/min for 1 ton of the molten steel), and the molten steel 2 is stirred for about 10 to 15 minutes. The desulfurizing slag 4 and the molten steel 2 are further stirred and mixed, and the molten steel 2 is thus desulfurized.

Figure 3:
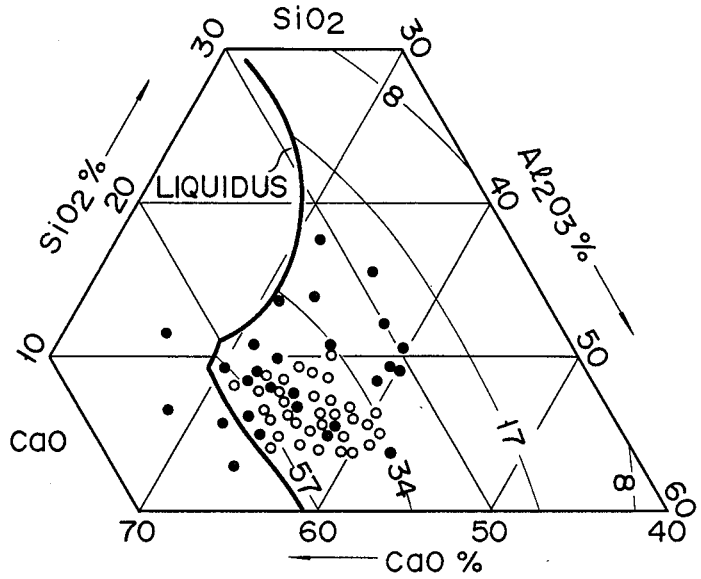
FIG. 3 is a representation showing a composition of a slag adjusted in accordance with this embodiment.

FIG. 3 is a representation showing a state of the $CaO—SiO_2—Al_2O_3$ slag in which a slag composition subjected to the desulfurizing process according to the present invention is compared with that subjected to a conventional desulfurizing process. In FIG. 3, solid dots represent the case where the desulfurizing flux is added to the molten steel while the converter slag remains on the molten steel, and the molten steel is stirred by gas introduced through injection equipment, thereby performing desulfurizing processing in accordance with the conventional process. Hollow dots represent the case, according to the process of the present invention, in which after the converter slag on the molten steel is removed by vacuum suction and the desulfurizing flux is added, the molten steel is arc-heated and is moderately stirred by Ar gas. Note that in FIG. 3, the curves represent slag composition when the sulfide capacity Cs' is respectively at 8, 17, 34 and 57. Table 1 shows an additive amount (kg per 1 ton of the molten steel) of the slag in both processes described above.

TABLE 1

| | Converter slag | CaO | Wollastonite | Al |
|---|---|---|---|---|
| Process of present invention | — | 7 to 10 | 2 | — |
| Conventional process | 5 to 10 | 5 to 9 | — | 0.3 to 0.4 |

As is apparent from FIG. 3, in the case of the present invention, the slag composition after the desulfurizing processing is most suitable for desulfurizing. On the contrary, in the case according to the conventional process, since the amount of the converter slag flowing into the ladle and the slag composition thereof are not uniform, the composition of the slag becomes unstable. Table 2 shows an oxidation degree of the slag.

TABLE 2

| | Process of present invention | Conventional process |
|---|---|---|
| Heat number n | 94 | 99 |
| FeO + MnO in slag (average value × (%)) | 0.04 | 0.72 |
| FeO + MnO in slag (standard deviation $\sigma$) | 0.02 | 0.24 |

In this manner, in the case according to the present invention, the desulfurizing slag has a low oxidation degree and small variation thereof. For this reason, an S distribution ratio (S)/[S] is high, and the desulfurizing efficiency is also high.

Figure 4:
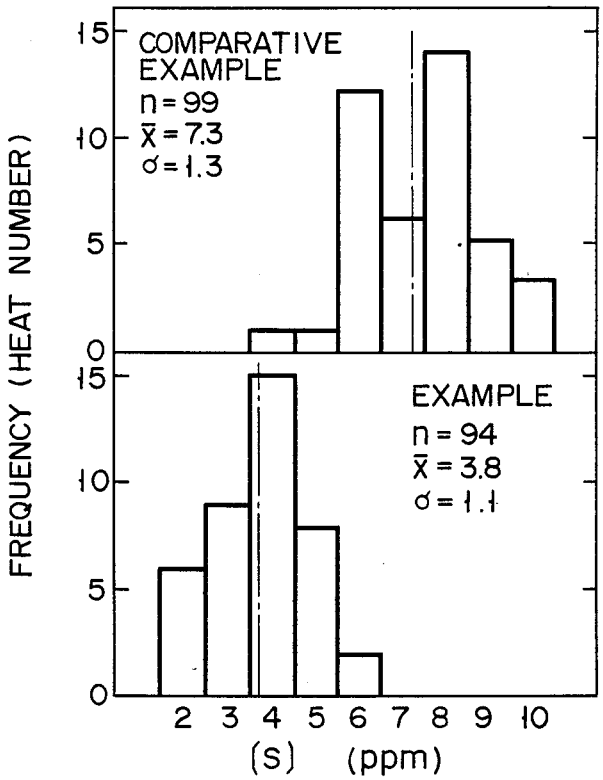
FIG. 4 is a graph showing an effect of the present invention.

As described above, according to the present invention, the composition of the desulfurizing slag falls within the optimal range for desulfurizing efficiency, and the slag oxidation degree is low. Therefore, the molten steel can be effectively desulfurized with high efficiency. FIG. 4 shows the sulfur concentration [S] in the molten steel after the desulfurizing process. As apparent from FIG. 4, in the case according to the present invention, an ultra low sulfur steel having the sulfur concentration [S] of 5 ppm or less can be stably manufactured. In other words, in the conventinal process, an averaage value $\bar{x}$ of the sulfur concentration [S] after the desulfurizing process is 7.3 ppm. In the process according to the present invention, the average value $\bar{x}$ is 3.8 ppm.

When the form of the inclusion is controlled, a Ca—Si alloy is added to the molten steel after the desulfurizing process, and CaS inclusions are precipitated as sulfide inclusions when the molten steel is solidified.

It should be noted that an injection method in which a Ca—Si alloy powder is carried by Ar or $N_2$ gas and is blown in the molten steel through a lance, a bullet shooting method, or a Ca wire method, can also be used.

In this case, since the sulfur content in the molten steel is decreased, the amount of the Ca—Si alloy added can be small. In addition, since a Ca yield is high when the Ca addition amount is small, the amount of the Ca—Si alloy added can be further decreased. More specifically, sulfide inclusion control can be performed by adding Ca so that a Ca concentration in the molten steel becomes 3 to 5 times the sulfur concentration [S] thereof. For example, in the case of the conventional method for controlling the forms of the inclusions which is not subjected to the desulfurizing step, the sulfur concentration [S] when the molten steel is poured from the converter is about 25 ppm, and a desired amount of the Ca—Si alloy to be added per charge (250 t of the molten steel) is about 300 kg. According to this embodiment, since the sulfur concentration [S] of the molten steel is decreased below 5 ppm, the amount of the Ca—Si alloy to be added per charge is about 60 kg if it is proportionally distributed. However, as is apparent from FIG. 5, when the Ca addition falls within the range between 0.3 and 0.4, the Ca yield is about 8%. On the contrary, when the Ca addition is 0.07, the Ca yield becomes extremely high, e.g., about 25%, which is three times the former value. For this reason, the actual amount of the Ca—Si alloy to be added per charge can be about 20 kg, which is ⅓ the proportionally distributed value.

The reason why the Ca yield is increased when the molten steel is subjected to the desulfurizing process so as to decrease the sulfur content [S] thereof below 5 ppm will be described hereafter.

Figure 5:
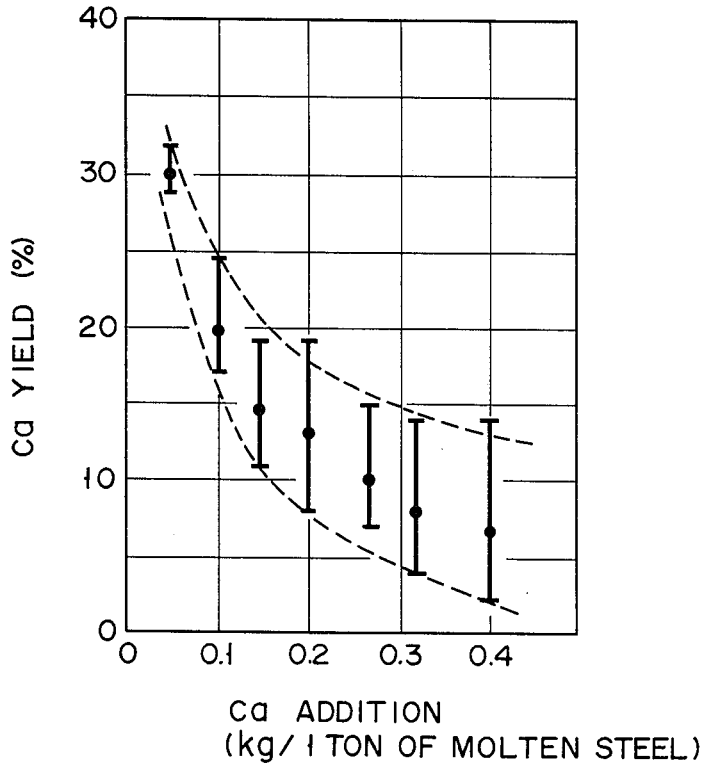
FIG. 5 is a graph showing the relationship between a Ca addition and the Ca yield.
Figure 6:
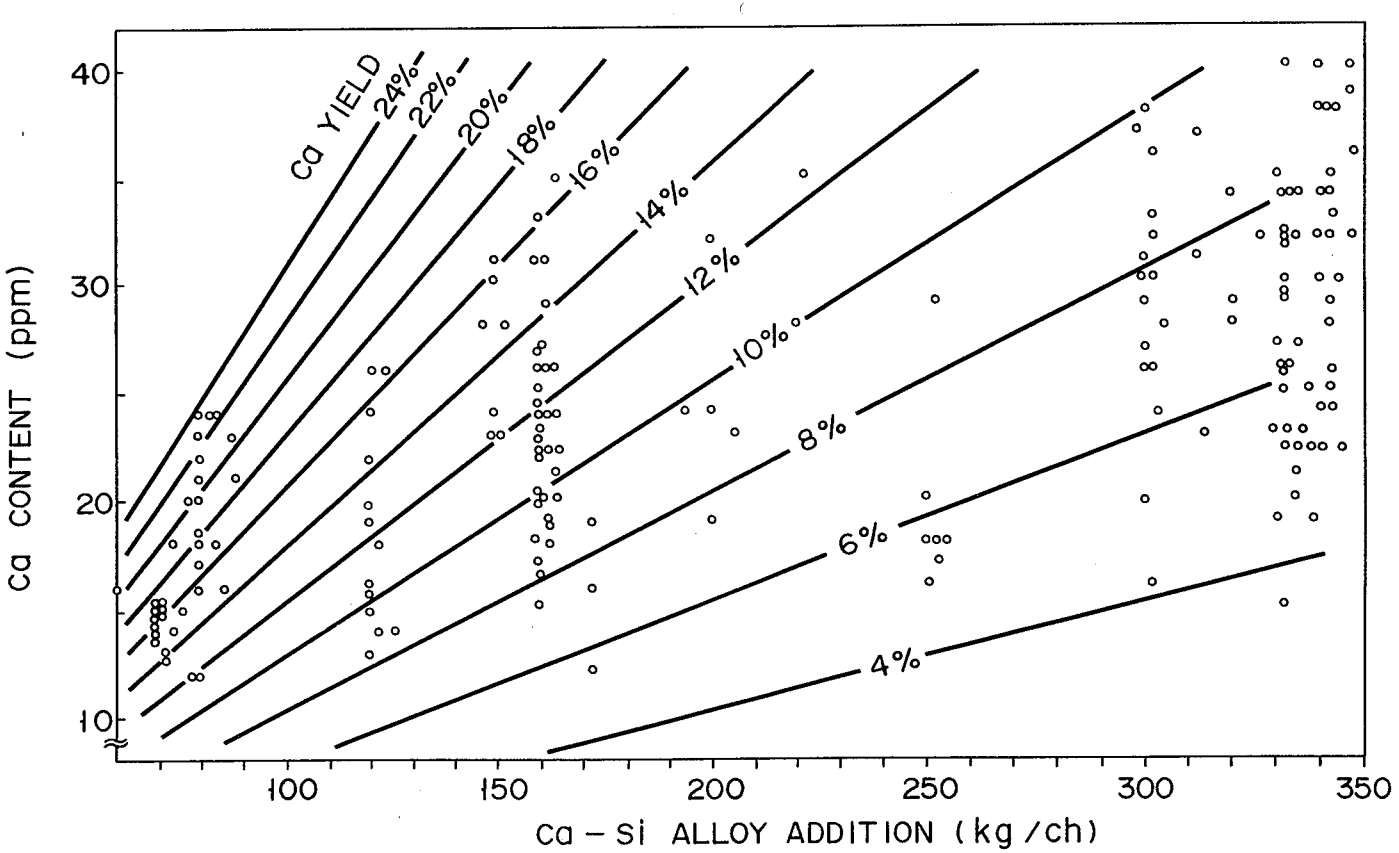
FIG. 6 is a graph showing the relationship between a Ca addition and the Ca content.

First, the test results of the Ca additive yield made by the present inventors will be described. FIG. 6 is a graph showing the relationship between the amount of Ca added and the Ca content. In FIG. 6, the ordinate represents the amount of the Ca—Si alloy added to the molten steel, and the abscissa represents Ca content while the molten steel in the ladle is casting. In FIG. 6, straight lines indicate the Ca additive yields. A method used for adding Ca is an injection method in which a Ca-Si alloy powder is carried by a gas and is blown into the molten steel. The temperature of the molten steel after adding Ca is 1,575° to 1,585° C. The blowing rate of the Ca—Si alloy powder is 30 to 35 kg/min. As is apparent from FIG. 6, when the amount of the Ca—Si alloy powder added is 300 kg or more, the Ca additive yield falls below 10% or less. On the contrary, the amount of Ca remaining in the steel is increased in accordance with a decrease in the amount of Ca—Si alloy added, thus improving the additive yield. FIG. 5 is a graph showing these test results with respect to the Ca additive yield. In FIG. 5, respective measurements are average values of twenty charges, and bars indicate respective ranges of variations thereof. The Ca additive yield gradually increases in accordance with a decrease in the Ca added unit (amount (kg)/molten steel (t) added). When the added unit is 0.1, the additive yield increased up to 20%. When the added unit is 0.05, the additive yield is increased up to 30%. Furthermore, variation in the Ca additive yield is small in accordance with a decrease in the Ca added unit.

Figure 7:
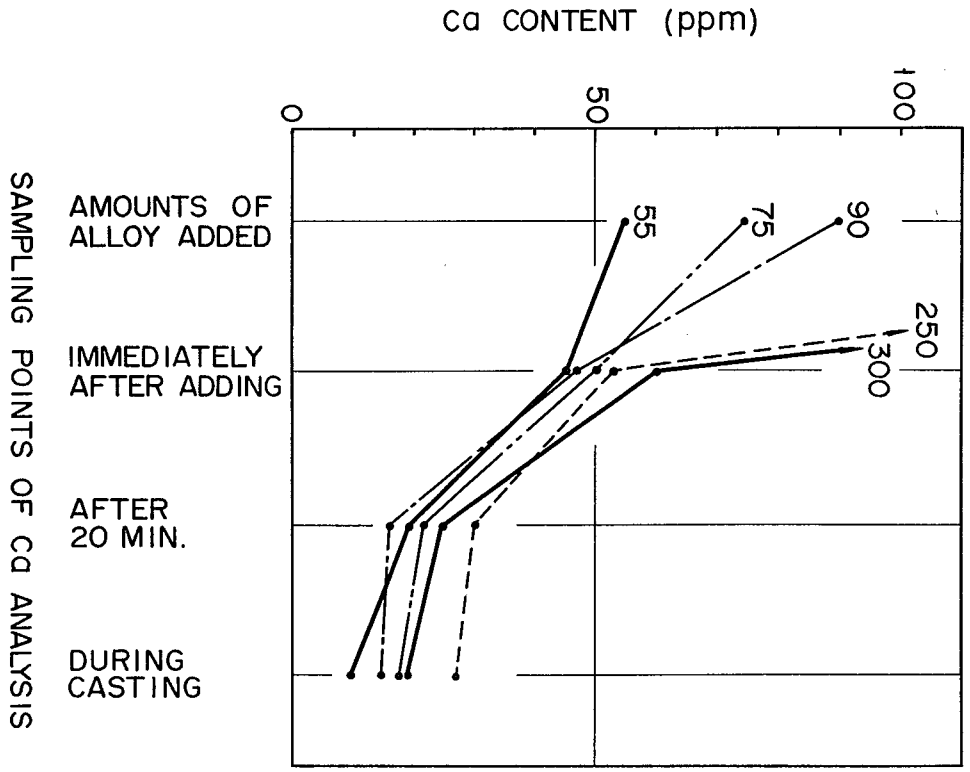
FIG. 7 is a graph showing Ca content over time.

This phenomenon can be described as follows. FIG. 7 shows a state in which in the Ca—Si alloy additive process, the Ca content is changed over time after the additive process. In FIG. 7, sampling points of Ca analysis samples are plotted along the abscissa, and analysis values (Ca content) are plotted along the ordinate. The amounts of the Ca—Si alloy added when they are converted into the Ca content are respectively 300, 250, 90, 75 and 55 ppm, as shown in FIG. 7. The Ca samples are sampled immediately after adding the Ca—Si alloy and 20 minutes thereafter. The Ca sample is also sampled from the molten steel during casting. The Ca content of each sample is analyzed, and the results are shown in FIG. 7. As apparent from FIG. 7, the amount of Ca—Si alloy added falls within the wide range between 55 and 300 ppm in terms of Ca content. However, immediately after adding the Ca—Si alloy, the Ca content is decreased between 45 to 60 ppm and the difference between the upper and lower limits becomes small. Furthermore, after 20 minutes has elapsed after addition, the Ca content decreases so as to to fall within the narrow range between 20 to 30 ppm. In this manner, even when the amount of the Ca—Si alloy added is extremely large after mixing in the molten steel, the Ca concentration decreases to an extent which is not so different from the case when the added amount is small. This can be explained as follows. In order to add the Ca—Si alloy to the molten steel, it cannot be added once, but must be added at a predetermined rate. For this reason, if the amount of the Ca—Si alloy added is large, a great deal of time is required to ensure an adequate reaction. In this case, since the molten steel is stirred by a carrier gas which is blown therein for adding the Ca—Si alloy, the added Ca—Si alloy is subjected to the influence of this stirring operation if the addition time is longer. Therefore, if a large amount of the Ca—Si alloy is added, Ca is separated from the molten steel by the stirring operation, resulting in large Ca loss. From the above explanation, in order to increase the Ca additive yield, the amount of the Ca—Si alloy added, that is, the Ca additive amount, must be small.

In this manner, after desulfurizing the molten steel poured from the converter to the ladle, when Ca is added in the molten steel in order to control formation of inclusions, the Ca additive yield becomes high and the variation thereof is small. Therefore, the desired Ca alloy additive amount can be small, resulting in low steelmaking cost. Since the additive time of the Ca alloy can be shortened, a decrease in a temperature of the molten steel can be small, and hydrogen and nitrogen pick-up of the molten steel can be reduced. In addition to this, when the Ca alloy is added by using an injection lance, the life of the lance can be prolonged. Furthermore, since the amount of the Ca alloy to be added is small, undesirable components due to the addition of Ca are not increased, thus preventing contamination of the molten steel.

What is claimed is:

1. A process for desulfurizing molten steel comprising the steps of: removing converter slag from molten steel; adding a desulfurizing flux onto the molten steel from which the converter slag has been removed; the desulfurizing flux being melted to a slag consisting essentially of 53 to 62 wt.% of CaO, 0 to 15 wt.% of $SiO_2$, and 30 to 45 wt.% of $Al_2O_3$; supplying power to electrodes at a predetermined distance from the molten steel so as to generate an electric arc, the desulfurizing flux being melted by arc-heating so as to form the slag; and introducing a gas into the molten steel through a lance submerged into the molten steel to stir the molten steel and the slag which are arc-heated.

2. The process according to claim 1, further comprising the step of introducing a gas in the molten steel through an auxiliary lance submerged into the molten steel to stir the molten steel and the slag after arc-heating.

3. The process according to claim 2, wherein the flow rate of the gas introduced in the molten steel from the lance is 1.6 to 3.2 Nl/min for 1 ton of the molten steel.

4. The process according to claim 3, wherein the flow rate of the gas introduced in the molten steel from the auxiliary lance is 8 Nl/min for 1 ton of the molten steel.

5. The process accordng to claim 4, wherein the gas introduced in the molten steel from the lance and the auxiliary lance is argon gas.

6. The process according to claim 5, further comprising the step of adding one of calcium and a calcium alloy to the molten steel so as to control the formation of a sulfide-based inclusion into a spherical shape in steel which is obtained by solidifying the molten steel, after the step of introducing the gas in the molten steel from the auxiliary lance so as to stir the molten steel and the slag.

7. The process according to claim 6, wherein calcium is added in an amount of not more than 0.1 kg for 1 ton of the molten steel.

* * * * *